United States Patent [19]

Engel et al.

[11] Patent Number: 4,791,799

[45] Date of Patent: Dec. 20, 1988

[54] STRUCTRUAL-SHAPE STEEL ROLLING MILL AND METHOD OF OPERATING SAME

[75] Inventors: Georg Engel, Kaarst; Dietmar Kosak, Neuss, both of Fed. Rep. of Germany

[73] Assignee: SMS Schloemann-Siemag Aktiengesellschaft, Dusseldorf, Fed. Rep. of Germany

[21] Appl. No.: 86,762

[22] Filed: Aug. 17, 1987

[30] Foreign Application Priority Data

Aug. 16, 1986 [DE] Fed. Rep. of Germany ..... 3627729

[51] Int. Cl.[4] ..... B21B 1/14; B21B 13/10

[52] U.S. Cl. ..... 72/225; 72/229; 72/235; 72/239

[58] Field of Search ..... 72/225, 229, 234, 235, 72/366, 238, 239

[56] References Cited

U.S. PATENT DOCUMENTS

| | | | |
|---|---|---|---|
| 3,251,213 | 5/1966 | Noda | 72/225 |
| 4,367,642 | 1/1983 | Nakanishi et al. | 72/225 |
| 4,370,877 | 2/1983 | Michaux | 72/225 X |

FOREIGN PATENT DOCUMENTS

| | | | |
|---|---|---|---|
| 0050903 | 4/1980 | Japan | 72/229 |
| 0100805 | 8/1980 | Japan | 72/225 |

*Primary Examiner*—Robert L. Spruill
*Assistant Examiner*—Steven B. Katz
*Attorney, Agent, or Firm*—Herbert Dubno

[57] ABSTRACT

The structural steel rolling mill comprises a reversing two high rough rolling mill, at least one universal working rolling mill and at least one flanging edging rolling mill included in a reversing tandem rolling mill group, and a universal finishing rolling mill at the outlet end of the structural steel rolling mill. The reversing tandem group following the rough rolling mill has a universal-working rolling mill, a flanging edging rolling mill and the universal finishing rolling mill. By including the universal finishing rolling mill in the reversing tandem rolling mill group the universal finishing rolling mill also participates in the reversing action and because of that is more effective in shaping than the standard finishing rolling mill so that in practice the special universal finishing rolling mill following the reversing tandem group is omitted as well as the edging rolling mill commonly provided with it and the roller bed located between them. The dimensional accuracy and the surface properties of the rolled product as well as the service life of the rolls of the universal finishing rolling mill are not impaired when the reduction of the universal finishing rolling mill is set smaller than that of the universal working rolling mill.

6 Claims, 3 Drawing Sheets

PRIOR ART

STRUCTRUAL-SHAPE STEEL ROLLING MILL AND METHOD OF OPERATING SAME

FIELD OF THE INVENTION

Our present invention relates to a structural-shape steel rolling mill for making a steel structural shape and a method of operating the mill.

More particularly, the invention relates to a structural-shape steel rolling mill for making a steel section including a reversing two-high rough-rolling mill, at least one universal working rolling mill and at least one flanging edging rolling mill comprising a reversing tandem rolling mill group and a universal finishing rolling mill provided at the outlet end of the structural-shape steel rolling mill.

BACKROUND OF THE INVENTION

The printed document W 2/3215 of the SMS SCHLOEMANN-SIEMAG the assignee of this application, describes a structural-shape steel mill of this general type.

Structural-shape steel rolling mills having a rough-rolling mill, a reversing universal rolling mill as well as a universal finishing rolling mill with corresponding flanging edging rolling mills may attain a high output at a relatively moderate capital cost since each run of the rolled product through the reversing tandem rolling mill group results in two universal passes in combination with an edging pass. For exact finishing of the structural-shape steel with a higher surface quality a universal finishing rolling mill is connected with a flanging edging rolling mill located downstream of the reversing tandem group, the universal finishing rolling mill and the flanging edging rolling mill being, however, not driven in reverse and being thus used only for a single pass.

OBJECTS OF THE INVENTION

It is an object of our invention to provide an improved structural-shape steel rolling mill which obviates drawbacks of earlier mills.

It is another object of our invention to provide an improved structural-shape steel rolling mill having a high output in which both the spatial requirements and the capital cost by comparison with known structural-shape steel rolling mills, are both considerably reduced.

It is an additional object of our invention to provide an improved method of operating a structural-shape steel rolling mill as described above more economically.

SUMMARY OF THE INVENTION

These objects and others which will become more readily apparent hereinafter are attained in accordance with our invention in a structural-shape steel rolling mill including a reversing two-high rough-rolling mill, at least one universal working rolling mill and at least one flanging edging rolling mill comprising a reversing tandem rolling mill group and a universal finishing rolling mill provided at the outlet end of the structural-shape steel rolling mill.

According to our invention the reversing tandem rolling mill group located downstream of the reversing rough-rolling mill has one universal working rolling mill, one flanging edging roll and the universal finishing rolling mill.

The mill can thus be made more economical and practical by eliminating the conventional finishing rolling mill group and its proportionately long roller bed since the universal finishing rolling mill can replace the downstream universal working rolling mill in the reversing tandem group.

Also one of the edging rolling mills can be eliminated. Thus the finishing rolling mill which previously performed only one pass with a smaller reduction according to the rolled material length, according to the invention, included in the reversing tandem group and is used substantially more heavily by participating in a reversing back-and-forth multipass operation or drive. The structural-shape steel rolling mill has an especially high throughput output which results in extensive heavy usage of all rolling mills considering the investment.

Advantageously the universal working rolling mill can have a plurality of vertical rolls with double conical roll bodies tapered to the roll pins and the universal finishing rolling mill has another plurality of vertical rolls with substantially cylindrical roll bodies. Also the universal working rolling mill can be interchangeable with the two-high rolling mill.

Also according to our invention an improved process or method of operating this structural-shape steel rolling mill includes adjusting the universal finishing rolling mill for a smaller reduction than that of the universal working rolling mill. Advantageously the reduction of the universal finishing rolling mill amounts to 15% to 55% of the universal working rolling mill.

BRIEF DESCRIPTION OF THE DRAWING

The above and other objects, features and advantages of our invention will become more readily apparent from the following description, reference being made to the accompanying highly schematic drawing in which.

SPECIFIC DESCRIPTION

Figure 1:
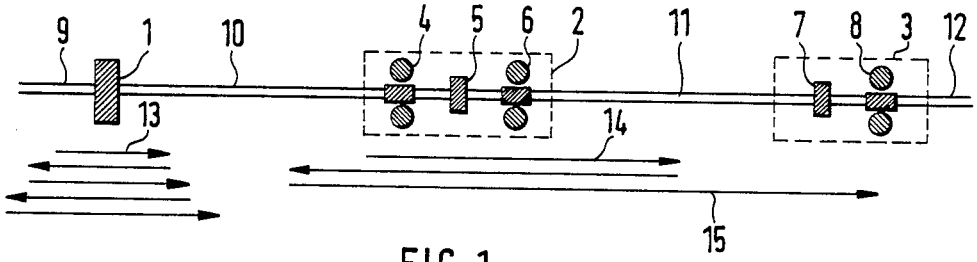
FIG. 1 is a diagrammatic representation of a conventional structural-shape steel rolling mill having a high output.

In FIG. 1 a conventional structural-shape steel rolling mill is illustrated diagrammatically.

Billets heated in a pusher furnace are rough rolled in a reversing rougher (or rough-rolling mill) 1, which is constructed as a two-high rolling mill, in a number of passes 13, usually between seven and fifteen.

The rough rolled billet is delivered to a reversing tandem rolling mill group 2 including a universal working rolling mill 4, a flanging edging roll stand or rolling mill 5 and a universal working rolling mill 6. By repeated rolling in three to five runs (arrows 14) the desired shape is more closely approached.

After the final run and/or during the final run the rolled item enters a finishing rolling mill group 3 (arrows 15) in which the supporting flanges are brought again to the exact set width by a flange edging rolling mill 7, while the universal finishing rolling mill 8 determines the final shape of the section and the surface quality of the rolled product.

At the reversing rougher or rough-rolling mill 1 an entrance roller bed 9 guides the material being rolled. A feed roller bed 10 is provided between it and the reversing tandem rolling mill group 2. Following the reversing tandem rolling mill group 2 there is a transfer roller bed 11 and the finishing rolling mill group 3 is followed by an output roller bed 12 which guides the material being rolled to a cooling bed.

The motion direction of the rolled material in the above named runs are indicated by arrows. Five arrows 13 show the five-pass rough rolling. The rolling down is indicated by the arrows 14 and 15. The arrow 15 indicates the edging and universal pass of the finishing rolling mill group 3.

Both the reversing rough-rolling mill 1 and also the reversing tandem rolling mill group 2 are designed for heavy shaping by reversing and thus are used optimally. Only the flanging edging rolling mill 7 and the universal finishing rolling mill 8 are set for a very slight reduction and act mostly to guarantee the desired close tolerances of the desired section and the surface quality of the rolled material.

Figure 2:
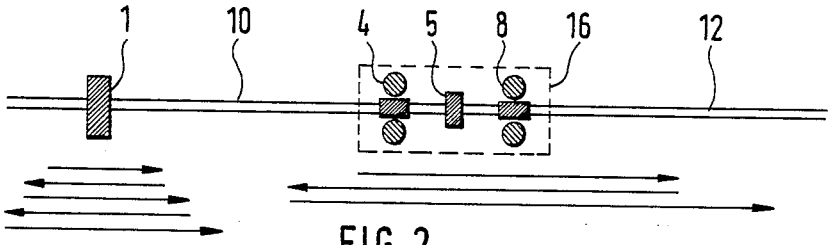
FIG. 2 is a similar diagrammatic representation of a substantially more economical structural-shape steel rolling mill of high output according to our invention.

To improve the use of all of the rolling mills, the mill line configuration is modified according to the invention to that shown in FIG. 2. The rough-rolling of the billets is effected also here by a rough-rolling mill 1 which permits a high shaping performance or effect by many passes in rough-rolling, for example five to thirteen passes.

The following reversing tandem rolling mill group 16 has a universal working rolling mill 4, a flanging edging rolling mill 5 and a universal finishing rolling mill 8.

These three rolling mills are used repeatedly and in back-and-forth passes. At least twice, if necessary more often, they are reversed.

Thus with two reversals, three edging passes and six universal passes occur.

Of course the use of this reverse tandem rolling mill group 16 is not as heavy as that of the reverse tandem rolling mill group 2.

Advantageously the universal working rolling mill 4 may operate with the optimum reduction while the finishing rolling mill 8 operates with a reduced reduction in contrast to that of the universal working rolling mill 4.

Additionally it is possible to effect the adjustment of the universal finishing rolling mill 8 in the final pass so that a further lowering of the reduction occurs.

By the lowering of the reduction caused by the universal finishing rolling mill 8 in contrast to the optimum a somewhat reduced shaping results; on the other hand the wear of the roll body surfaces of the universal finishing rolling mill 8 in contrast to that of the universal working rolling mill 4 is lowered so that they have satisfactory properties for a longer service life. Also the output rolled product determined by the surface properties of the roll bodies of the universal finishing rolling mill 8 has an excellent quality or properties over a longer service life.

Consequently in contrast to the known configuration of FIG. 1 a finishing rolling mill group with the associated roller bed is omitted and the space taken up by it is saved.

The total amount of shaping may be slightly reduced since of course the contribution of the universal working rolling mill 4 is optimized but only a portion of the optimum shaping capacity of the universal finishing rolling mill 8 is used.

Actually the separate run through a separate single-pass finishing rolling mill group is eliminated. Of course it is also known to make the transfer roller bed 11 so short that the length of the rolled material attained after the final pass through the universal working rolling mill 6 (FIG. 1) is such that the head of the rolled material enters the finishing rolling mill group 3 before its end leaves the universal working rolling mill 6. A further controlling arrangement is required however for a bump or shock free transfer in the conventional mill. However in the rolling mill according to our invention the roller bed 11 is omitted.

The universal working rolling mill 4, the flanging edging rolling mill 5 and the universal finishing rolling mill 8 can be controlled according to the law or principle of minimum force so that the occurring stresses are kept minimum.

Figure 3:
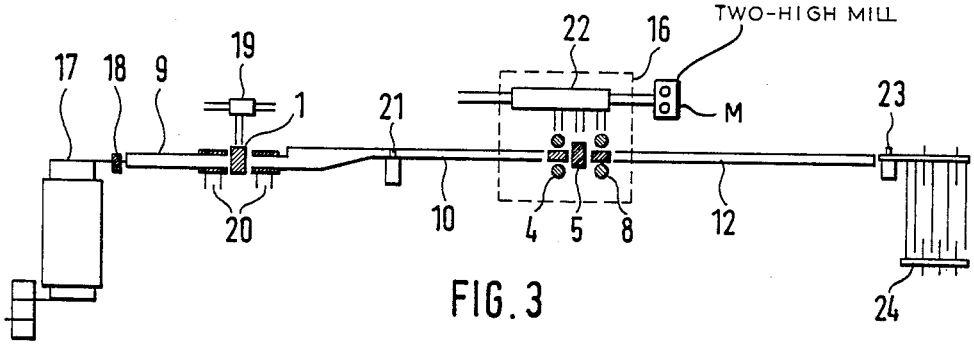
FIG. 3 is a similar diagrammatic representation of a structural-shape steel rolling mill according to our invention.

Another practical example of the compact structural-shape steel rolling mill of high performance is indicated schematically in FIG. 3.

Here the billet heated in the pusher oven 17 with its feed device is shown as well as a descaler 18 following it. The heated and descaled billet is fed by the entrance roll bed 9 to the reversing rough-rolling mill 1 associated with the fast roll changing device 19 and the edging and sliding devices 20 up and downstream of it.

The preliminarily worked section is brought to the reversing tandem rolling mill group 16 by a feed roll bed 10 which is equipped with a hot saw 21. A roll stand changing device 22 is associated with the stands 4, 5 and 8 of this group which allows the exchange of the stands with reconditioned stands. For example, a two-high mill M can be substituted by the changer 22 for one of the universal mills 4 or 8. The stands provided for a two-high or universal operation are inserted as desired or need arises. A downstream output roll bed 12 leads over a hot shearer 23, e.g. used to divide into the rolled products, standard lengths, to a cooling bed 24.

In practice it has been shown that a compact structural-shape steel rolling mill results from the new assembly of essential previously used rolling mills so that according to the invention the expense of operation is considerably lowered. The performance drop which occurs by reducing the amount of shaping of the universal finishing rolling mill may be easily compensated as the case requires by an additional reversal and corresponding increase in the number of passes.

Figure 4:
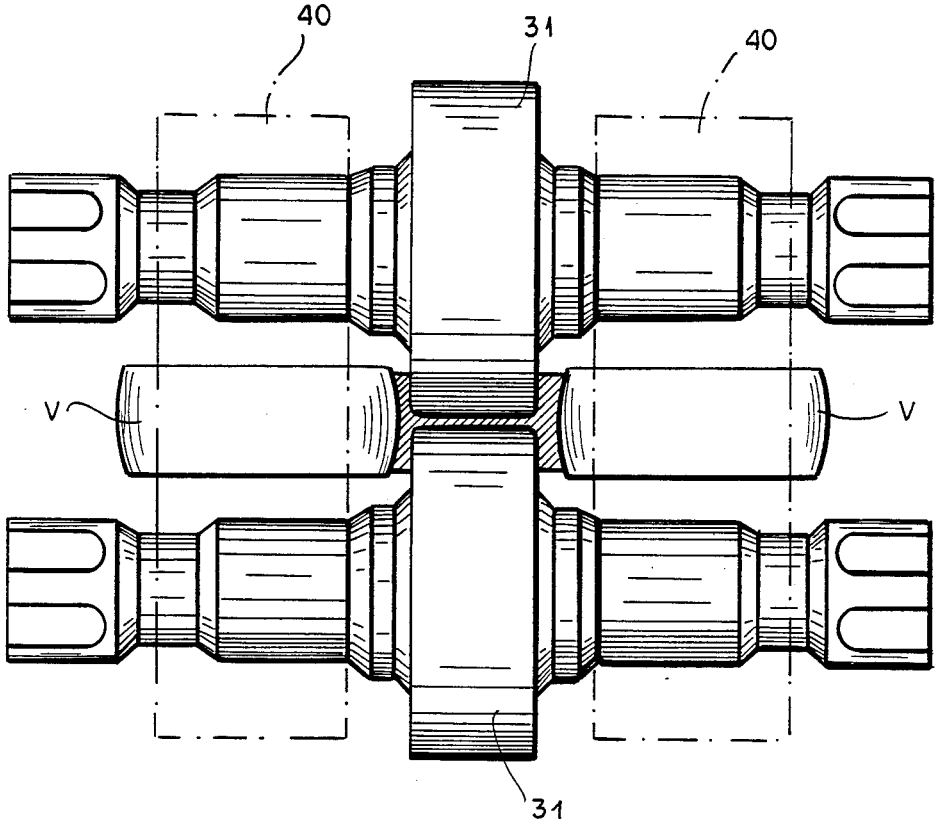
FIG. 4 is a schematic side elevational view of a universal working rolling mill.
Figure 5:
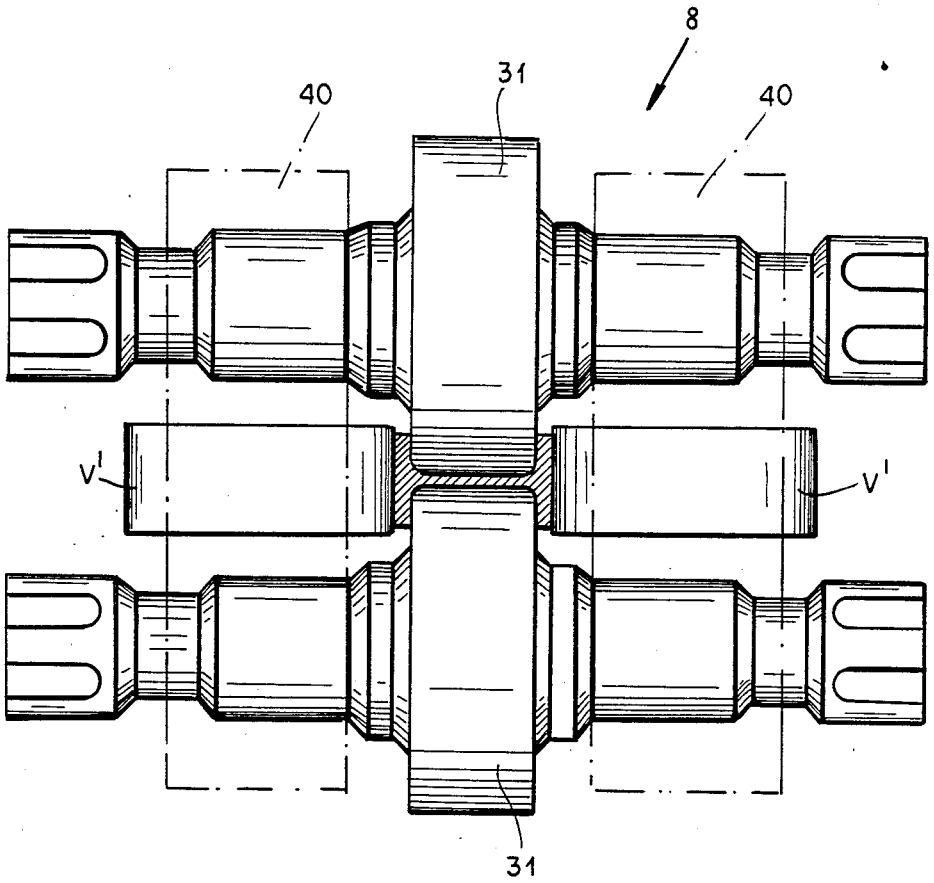
FIG. 5 is a similar view of a universal finishing rolling mill.

Customarily in the reversing tandem rolling mill group the vertical rolls v of the universal working rolling mill 4 are formed double conical gently tapered so that their bodies are tapered from their center planes to their roll pins p. These vertical rolls v are mounted with the horizontal rolls 31 in the roll stand 40 as shown in FIG. 4. Contrastingly compare FIG. 5, the universal finishing rolling mill 8 can have cylindrical vertical rolls v′ as well as horizontal cylindrical rolls 31 mounted in the roll stand 40. The rolled section has gently outwardly canted flange halves so that one can refer to the so-called "X" profile visible in FIG. 4. The universal finishing rolling mill contains substantially cylindrical vertical roll bodies so that the flange halves maintain a common outer plane and one obtains the desired "H" section. The universal working rolling mill 4 can be equipped advantageously with double conical rolls and the universal finishing rolling mill 8 with cylindrically shaped vertical rolls so that in reversing two passes occur in the "H" form followed by two in the "X" form and the final pass occurs in the "H" form. Thereby additionally a complete reshaping of the flange root region is attained.

We claim:

1. In a structural-shape steel rolling mill with a two-high reversing rough-rolling mill, at least one universal working rolling mill and at least one flanging edging rolling mill comprising a reversing tandem rolling mill group and a universal finishing rolling mill provided at the outlet end of said structural-shape steel rolling mill, the improvement wherein said reversing tandem rolling mill group located downstream of said reversing rough-rolling mill has one of said universal working rolling mills, one of said flanging edging rolling mills and said universal finishing rolling mill.

2. The improvement defined in claim 1 wherein said universal working rolling mill has a plurality of vertical rolls each with a double conical roll body tapered to the roll pins and said universal finishing rolling mill has another plurality of said vertical rolls with substantially cylindrical ones of said roll bodies.

3. The improvement defined in claim 1, further comprising means for interchanging one of said universal rolling mills with a two-high rolling mill.

4. A method of operating a structural-shape steel rolling mill including a reversing rough rolling mill and a reversing tandem rolling mill group downstream of said rough rolling mill and comprising in sequence a universal working rolling mill, a flanging edging rolling mill, and a universal finishing rolling mill, said method comprising:

passing a workpiece in a plurality of passes through said rough rolling mill;

thereafter passing said workpiece in a plurality of passes through all the mills of said group; and adjusting said universal finishing rolling mill for a smaller reduction than said universal working rolling mill.

5. The process defined in claim 4 wherein said reduction of said universal finishing rolling mill amounts to from 15% to 55% of that of said universal working rolling mill.

6. A structural-shape steel rolling mill comprising:

a reversing rough rolling mill; and a reversing tandem rolling mill group located downstream of said rough-rolling mill and comprising:

a universal working rolling mill, a flanging edging rolling mill downstream of said universal working rolling mill, and a universal finishing rolling mill downstream of said flanging edging rolling mill and having a plurality of vertical rolls with cylindrical roll bodies; and means for interchanging at least one of said universal rolling mills with a two-high rolling mill.

* * * * *